US006224517B1

(12) United States Patent
Dereszynski

(10) Patent No.: US 6,224,517 B1
(45) Date of Patent: May 1, 2001

(54) WEIGHTED FLEXIBLE EXERCISE DEVICE

(76) Inventor: Lisa D. Dereszynski, R.R. 1, Box 898, Salem, ME (US) 04983

( * ) Notice: Subject to any disclaimer, the term of this patent is extended or adjusted under 35 U.S.C. 154(b) by 0 days.

(21) Appl. No.: 09/109,980

(22) Filed: Jul. 2, 1998

(51) Int. Cl.[7] ..... A63B 21/072
(52) U.S. Cl. ..... 482/93; 482/105; 482/108
(58) Field of Search ..... 482/93, 105, 108, 482/44, 49, 50, 148; 5/636, 637, 644, 655.4; 607/108–111, 96; 602/13

(56) References Cited

U.S. PATENT DOCUMENTS 1,386,652 * 8/1921 Patton ..... 5/636
3,872,905 * 3/1975 Gaiser et al. ..... 150/8
4,011,611 * 3/1977 Lederman ..... 5/655.4
4,112,179 * 9/1978 Maccalous et al. ..... 428/325
4,137,920 * 2/1979 Evans ..... 5/655.4
4,332,379 * 6/1982 Bannister ..... 482/105
4,357,009 * 11/1982 Baker ..... 482/105
4,695,051 * 9/1987 Jenison ..... 482/108
5,074,459 * 12/1991 Harvey ..... 482/105
5,359,739 * 11/1994 Rains et al. ..... 5/81.1
5,857,946 * 1/1999 Brown ..... 482/108

* cited by examiner

*Primary Examiner*—John Mulcahy
(74) *Attorney, Agent, or Firm*—Dennison, Scheiner, Schultz & Wakeman

(57) ABSTRACT

A weighted flexible exercise device made of a flexible material in an I shape containing a fluid or particulate weight, such device being generally loose and flexible for performing a variety of exercises utilizing its shape as providing both grasping areas and areas which frictionally catch and interact with the user's body.

5 Claims, 2 Drawing Sheets

WEIGHTED FLEXIBLE EXERCISE DEVICE

BACKGROUND OF THE INVENTION

1. Field of the Invention

The present invention resides in the field of weighted exercise devices and more particularly relates to a flexible weight training device designed to work parts of the entire body.

2. Description of the Prior Art

Health and fitness professionals agree that exercise is an important part of staying healthy. Exercise experts recommend an exercise program which includes weight training, aerobic conditioning, and flexibility exercises. Weight training has many beneficial effects including increasing the percentage of muscle over the percentage of fat in the body. Weight training has also been shown to help in preventing and reversing the effects of osteoporosis. Weight training also strengthens the body and increases endurance so that one's daily activities are less tiring.

Clearly, exercise has many benefits. Yet many people do not exercise on a regular basis. There are various reasons for this, including lack of time and the expense of health club memberships. Many also do not have the physical space required for the equipment needed to receive a total body workout. Even when one has invested the money and has the space for such equipment, many exercise devices are not portable and thus impractical for those who regularly travel.

Among the types of patented exercise devices are barbell and dumbbell devices. Some are designed to accommodate varying levels of weight. Examples include Pelletier et al. U.S. Pat. No. 850,964; Matysek U.S. Pat. No. 1,366,200; and Ionel U.S. Pat. No. 4,076,236. In certain devices a user regulates the weight by filling the device with a fluid. Examples include Mackenzie et al. U.S. Pat. No. 812,144; Bosko et al. U.S. Pat. No. 3,334,899; and Jenison U.S. Pat. No. 4,695,051.

U.S. Pat. No. 5,393,284 to Wesley discloses a flexible barbell apparatus. An elongated flexible tube has at opposite ends vessels for holding weight. The tube is adapted to receive a rigid bar. The device is flexible and can be used for various exercises but is not designed to form fit around a body part or to isolate specific areas of the body for a workout. Weighted flexible bags are also found in the prior art and can drape around a body part.

U.S. Pat. No. 4,538,806 to Wilkerson describes an exercise barbell. Each of its ends contains a soft, pliable covering over a mass of weighting material. The center, however, is supported by a rigid axial member, reducing any flexibility at its central portion. Thus, the device cannot accommodate certain exercises.

SUMMARY OF THE INVENTION

The present invention discloses an I-shaped flexible weight that can be held in the hands of the user for all dumbbell type exercises and can also be draped over any part of the body for isolated weight resistance training. It can be used on virtually every muscle to provide a total body workout. This device helps to strengthen, tone, and stretch muscles and soft connective tissues.

It is an object of this invention to provide a flexible weight training device that helps an individual stretch, build, tone, and strengthen muscles and connective tissues. The device helps the exerciser raise his metabolism and lose unwanted body fat. It provides balanced, consistent weight resistance without having to twist, strap, or tie anything.

It is a further object of this invention to provide a device that promotes safety in all aspects of its use. Unlike ankle weights, the device of this invention cannot be strapped to the user, thus preventing injuries, such as shin splints, caused by strapped exercise devices. Also, with this device, the user cannot simply propel his body around in a dangerous manner. The device forces the user to use safe, slow, and controlled movements which most health professionals recommend. Also, the device is soft and cannot cause injury when accidentally dropped.

It is yet a further object of this invention to provide a portable device ideal for travel. The device is easy to pack and thus can be used anywhere. It takes up little space and can be easily stored.

It is yet still a further object of this invention to provide an exercise device that allows a user to increase flexibility to help prevent injuries. One simply places the device on a certain body part; and by using specific relaxation techniques, one stretches the desired body part. One can also apply the device to achieve resistance stretches such as those used in physical therapy. For example, to stretch the calf muscles, one would place his toes in the handle or central portion of the device and hold the ends of the device, pulling back until one feels the stretch, and then holding the stretch and resisting by pushing the toes forward, relaxing, and then stretching again.

It is yet still a further object of this invention to provide a versatile exercise device that can work areas of the body that many weight machines are not designed for working. For example, a weight machine may only be designed to work the hamstring and only in a selected area of that muscle. This device lets an individual work the muscle group of the inside, outside, lower hamstring, and upper hamstring simply by changing the positioning slightly of the device. Therefore, by using the device of this invention one receives a more balanced overall total body workout by working the entire group of muscles, instead of just one spot.

DESCRIPTION OF THE PREFERRED EMBODIMENT(S)

Figure 1:
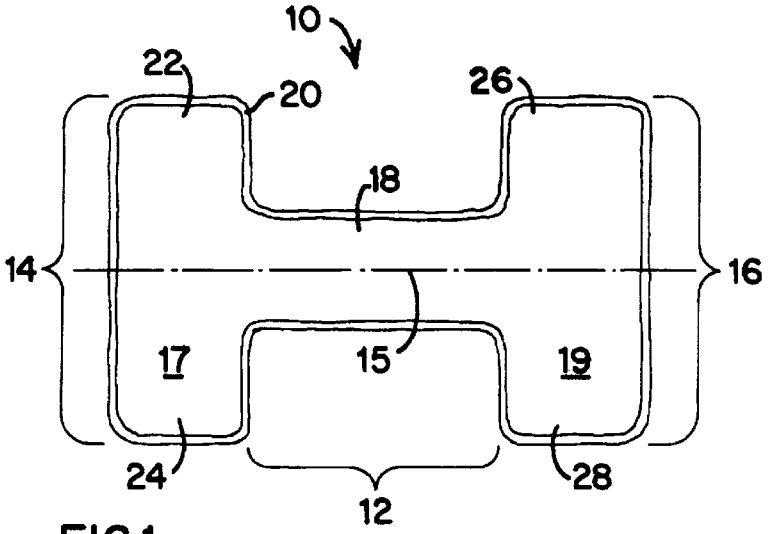
FIG. 1 illustrates a top view of the weighted flexible exercise device of this invention.
Figure 2:
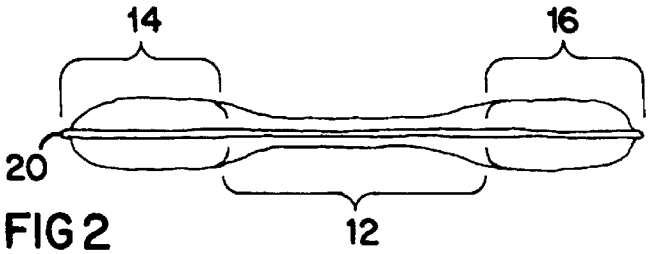
FIG. 2 illustrates a side view of the weighted flexible exercise device.

The weighted flexible exercise device is shown in FIGS. 1 and 2, in top and side views, respectively. Weighted flexible exercise device 10 has a central portion 12 having a central axis 15 and first and second wings 14 and 16 extending perpendicular to axis 15 and is shaped like the letter "I." Portions of wings 14 and 16 extend beyond central portion 12, comprising wing extensions 22, 24, 26 and 28. First and second surface areas 17 and 19, respectively, of first and second wings 14 and 16 form areas for surface traction against the user's body in certain exercises. Outer covering 18 can be made of rip stop nylon with a plastic inner lining (not shown) for use with a liquid filler. The hollow member of the flexible exercise device can be pre-filled with sand, gel or other particulate or liquid to provide the weight. Exercise device 10 can generally weigh between 2–30 pounds in a preferred embodiment. After sand or other fluid material is added to reach a predetermined weight, nylon covering 18 is sewn at seams 20 to prevent leakage of any sand or other particulate material. If a liquid is used, outer covering 18 can be of a flexible plastic material and the seams can be glued or heat-sealed. In some embodiments the material can be neoprene or equivalent. Henceforth, whenever sand is mentioned as the filler material, it should be understood to include usage of other filler materials including liquids. Such filler material can be referred to as "fluid material" as both particulate material and fluids act similarly within the device of this invention. The particulate material can include steel or other metal pellets. Lighter devices can use plastic pellets. A reclosable opening can be provided to add pellets to the device or remove them to change its weight and also its feel and frictional characteristics against the user's body. Depending on the exercise to be performed, the user can vary the amount of fluid material (i.e. weight) apportioned between the wings and central portion of the weighted flexible exercise device, which wings and central portion are hollow and open to one another and filled with the chosen fluid material.

Figure 3:
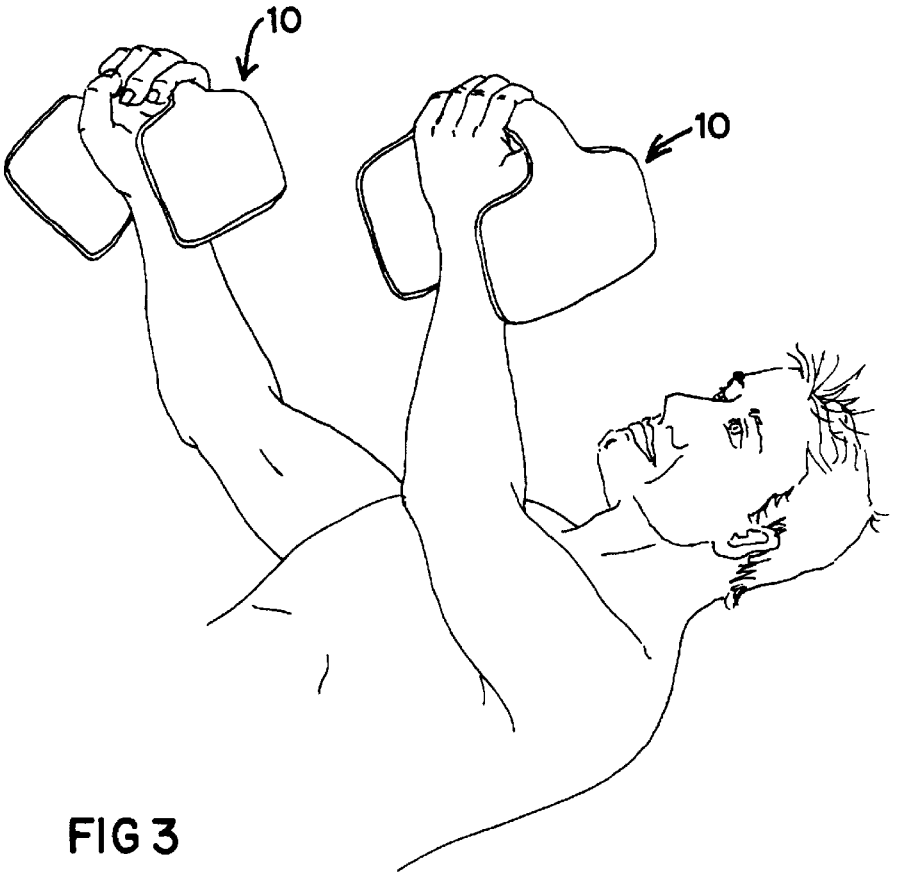
FIG. 3 illustrates a view of a person holding a pair of the weighted flexible exercise devices, one in each hand, and performing traditional dumbbell-type exercises.

The weighted flexible exercise device is uniquely shaped to provide balance on the body and therefore allows the user to perform a wide variety of exercises. Further the shape of the wing extensions can catch on parts of the user's body. FIG. 3 illustrates a user performing dumbbell exercises with a pair of exercise devices 10, one in each hand. As shown in FIG. 3, the user can work the wrists and forearms and other parts of the body by holding exercise devices 10 at shoulder level and turning the devices in one direction and then in the opposite direction.

Figure 4:
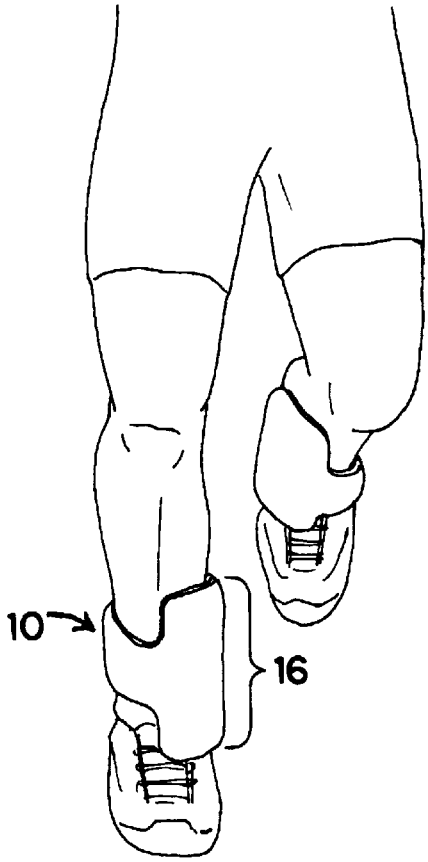
FIG. 4 illustrates a partial view of a person using the weighted flexible exercise device on his lower leg.

FIG. 4 illustrates a user performing exercises on the legs with exercise device 10 wrapped around one ankle. For toning the back of the legs, the user stands on one foot and lays the exercise device around the ankle with toes pointed and then raises and lowers the foot in a curling motion. This exercise focuses on the buttock and hamstring muscles.

Figure 5:
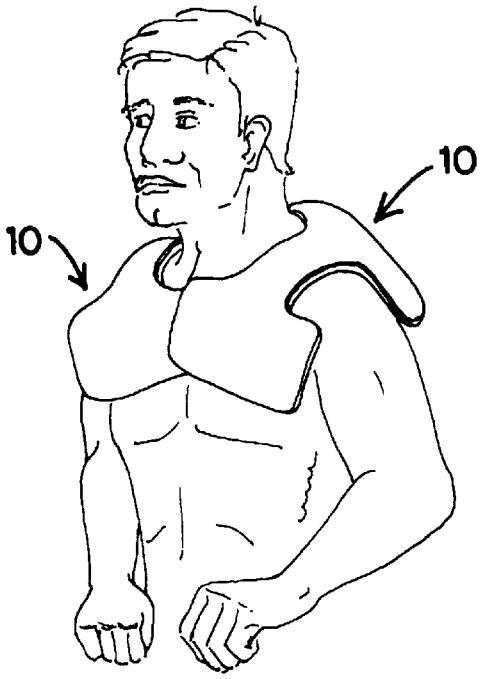
FIG. 5 illustrates a perspective view of a person wearing a pair of the weighted flexible exercise devices, one on each shoulder.

FIG. 5 shows a user with a weighted flexible exercise device 10 disposed on each shoulder. Placing the devices on the shoulders is useful in such exercises as lunges and squats. The user can lay the devices on the shoulders and, with the knees facing forward, lower and raise the body while bending at the knees. The weighted flexible exercise device conforms to the body of the user and naturally stays in place thereon. The device stays in place because the weighted wings conform to the contour of the body, and surface friction of the weighted device against the body helps hold the device in place. The extra resistance the devices provides lessens the number of squats needed for maximum effect.

The user can perform numerous other exercises using the weighted flexible exercise device of this invention. To work the hips, abdominals, and top of the legs, the user stands on one foot and lays the exercise device on top of the foot, raising and lowering the foot to the floor. The upper abdominal muscles get some extra toning benefits when the user lays the device on top of the chest and proceeds to do the usual crunches. For extra weight resistance during pushups, the user can place the weighted exercise device around the neck and proceed with normal pushups. The weighted flexible exercise device is useful for one trying to lose weight and seeking to strengthen and tone the body. Its unique I-shape helps the device conform to most body parts and stay in place effectively. The frictional resistance provided by wing extensions 22, 24, 26 and 28 against the user's body helps the device stay in place during use.

Although the present invention has been described with reference to particular embodiments, it will be apparent to those skilled in the art that variations and modifications can be substituted therefor without departing from the principles and spirit of the invention.

I claim:

1. In a dumbbell comprising a housing containing a weight material, the improvement wherein:

said housing comprises first and second sheets of flexible material, said first and second sheets each being I-shaped, including an elongate central portion having straight sides and first and second wings extending perpendicular to the long axis of the central portion at each end thereof with portions of the wings extending beyond the central portion to form wing extensions, said first and second sheets being joined all along their peripheries to form an I-shaped compartment containing said weight material, said central portion forming a handle means for grasping said housing as a dumbbell; and said weight material comprising a particulate material that substantially fills said housing while allowing said central portion to flex.

2. The device of claim 1 wherein said flexible material comprises an inelastic material.

3. The device of claim 2 wherein said inelastic material comprises rip stop nylon.

4. The weight of claim 1 wherein said particulate material is selected from the group consisting of sand, plastic pellets, and metal pellets.

5. The device of claim 1 wherein said flexible flexible material is made of rip stop nylon and further includes a plastic inner lining to hold said particulate material.

* * * * *